US008740554B2

(12) United States Patent
Virkler et al.

(10) Patent No.: US 8,740,554 B2
(45) Date of Patent: Jun. 3, 2014

(54) COVER PLATE WITH INTERSTAGE SEAL FOR A GAS TURBINE ENGINE

(75) Inventors: Scott D. Virkler, Ellington, CT (US); Roger Gates, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 722 days.

(21) Appl. No.: 13/004,273

(22) Filed: Jan. 11, 2011

(65) Prior Publication Data

US 2012/0177485 A1 Jul. 12, 2012

(51) Int. Cl.

| | |
|---|---|
| ***F01D 11/08*** | (2006.01) |
| ***F01D 1/10*** | (2006.01) |
| ***F01D 5/30*** | (2006.01) |
| ***F01D 11/00*** | (2006.01) |

(52) U.S. Cl.

CPC ..... *F01D 1/10* (2013.01); *F01D 5/3015* (2013.01); *F01D 11/001* (2013.01)

USPC ..... 415/173.7; 415/174.1; 415/174.5; 416/201 R

(58) Field of Classification Search

USPC ..... 415/173.7, 174.1, 174.5; 416/198 A, 416/200 A, 201 R

See application file for complete search history.

(56) References Cited

U.S. PATENT DOCUMENTS

| | | | | |
|---|---|---|---|---|
| 2,988,325 | A | | 6/1961 | Dawson |
| 3,733,146 | A | | 5/1973 | Smith et al. |
| 3,982,852 | A | | 9/1976 | Andersen et al. |
| 4,468,148 | A | * | 8/1984 | Seymour ..... 416/198 A |
| 4,582,467 | A | | 4/1986 | Kisling |
| 4,645,424 | A | | 2/1987 | Peters |
| 4,659,289 | A | | 4/1987 | Kalogeros |
| 4,803,893 | A | * | 2/1989 | Bachinski ..... 416/193 A |
| 4,822,244 | A | | 4/1989 | Maier et al. |
| 4,854,821 | A | | 8/1989 | Kernon et al. |
| 4,882,902 | A | | 11/1989 | Reigel et al. |
| 4,890,981 | A | | 1/1990 | Corsmeier et al. |
| 5,173,024 | A | | 12/1992 | Mouchel et al. |
| 5,236,302 | A | | 8/1993 | Weisberger et al. |
| 5,275,534 | A | | 1/1994 | Cameron et al. |
| 5,338,154 | A | | 8/1994 | Meade et al. |
| 5,472,313 | A | | 12/1995 | Quinones et al. |
| 5,503,528 | A | * | 4/1996 | Glezer et al. ..... 416/96 R |
| 5,630,703 | A | | 5/1997 | Hendley et al. |
| 5,816,776 | A | | 10/1998 | Chambon et al. |
| 5,833,244 | A | * | 11/1998 | Salt et al. ..... 415/170.1 |
| 5,954,477 | A | | 9/1999 | Balsdon |
| 6,053,697 | A | | 4/2000 | Pickarski et al. |
| 6,077,035 | A | | 6/2000 | Walters et al. |
| 6,106,234 | A | | 8/2000 | Gabbitas |
| 6,227,801 | B1 | | 5/2001 | Liu |
| 6,283,712 | B1 | | 9/2001 | Dziech et al. |
| 6,334,755 | B1 | | 1/2002 | Courdray et al. |
| 6,575,703 | B2 | | 6/2003 | Simeone et al. |

(Continued)

*Primary Examiner* — Igor Kershteyn

(74) *Attorney, Agent, or Firm* — Carlson, Gaskey & Olds, P.C.

(57) ABSTRACT

An air seal assembly for a gas turbine engine includes a first cover plate with a radially extending knife edge seal defined about and axis of rotation. The first cover plate is mountable to a first rotor disk for rotation therewith, the first radially extending knife edge seal interfaces with a vane structure. A second cover plate with a second radially extending knife edge seal defined about the axis of rotation, the second cover plate mountable to the second rotor disk for rotation therewith. The second radially extending knife edge seal interfaces with the vane structure.

19 Claims, 4 Drawing Sheets

(56) References Cited

U.S. PATENT DOCUMENTS

| | | | | |
|---|---|---|---|---|
| 6,749,400 | B2 | 6/2004 | Dougherty et al. | |
| 6,877,950 | B2 | 4/2005 | Liu | |
| 6,899,520 | B2 | 5/2005 | Habedank et al. | |
| 6,910,852 | B2 | 6/2005 | Simeone et al. | |
| 6,981,841 | B2 | 1/2006 | Krammer et al. | |
| 7,040,866 | B2 | 5/2006 | Gagner | |
| 7,179,049 | B2 | 2/2007 | Glasspoole | |
| 7,322,101 | B2 | 1/2008 | Suciu et al. | |
| 7,331,763 | B2 | 2/2008 | Higgins et al. | |
| 7,344,354 | B2 | 3/2008 | Lammas et al. | |
| 7,430,802 | B2 * | 10/2008 | Tiemann | 29/889.22 |
| 7,458,774 | B2 | 12/2008 | Albrecht, Jr. et al. | |
| 7,520,718 | B2 * | 4/2009 | Engle | 415/173.7 |
| 7,743,613 | B2 | 6/2010 | Lee et al. | |
| 2007/0059158 | A1 * | 3/2007 | Alvanos et al. | 415/115 |
| 2010/0040479 | A1 | 2/2010 | Spangler et al. | |
| 2010/0089019 | A1 | 4/2010 | Knight et al. | |
| 2010/0092278 | A1 | 4/2010 | Major et al. | |
| 2010/0124495 | A1 | 5/2010 | Bifulco | |
| 2010/0150711 | A1 | 6/2010 | Beaulieu | |

* cited by examiner

COVER PLATE WITH INTERSTAGE SEAL FOR A GAS TURBINE ENGINE

BACKGROUND

The present disclosure relates to gas turbine engines, and in particular, to an interstage seal assembly.

Gas turbine engines with multiple turbine stages include interstage seal arrangements between adjacent stages for improved operating efficiency. The interstage seal arrangements confine the flow of hot combustion core gases within an annular path around and between stationary turbine stator blades, nozzles and also around and between adjacent rotor blades.

The interstage seal arrangements may also serve to confine and direct cooling air to cool the turbine disks, the turbine blade roots, and also the interior of the rotor blades themselves as rotor blade cooling facilities higher turbine inlet temperatures, which results in higher thermal efficiency of the engine and higher thrust output. The interstage seal configurations must also accommodate axial and radial movements of the turbine stage elements during engine operation as the several elements are subjected to a range of different loadings and different rates of expansion based upon local part temperatures and aircraft operating conditions.

SUMMARY

An air seal assembly for a gas turbine engine according to an exemplary aspect of the present disclosure includes a first cover plate with a radially extending knife edge seal defined about and axis of rotation. The first cover plate is mountable to a first rotor disk for rotation therewith, the first radially extending knife edge seal interfaces with a vane structure. A second cover plate with a second radially extending knife edge seal defined about the axis of rotation, the second cover plate mountable to the second rotor disk for rotation therewith. The second radially extending knife edge seal interfaces with the vane structure.

A method to assemble an air seal assembly of a gas turbine engine according to an exemplary aspect of the present disclosure includes mounting a first cover plate with a radially extending knife edge seal defined about an axis of rotation to a first rotor disk for rotation therewith, the first radially extending knife edge seal interfacing with a vane structure and mounting a second cover plate with a radially extending knife edge seal defined about an axis of rotation to a second rotor disk for rotation therewith, the second radially extending knife edge seal interfacing with the vane structure.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
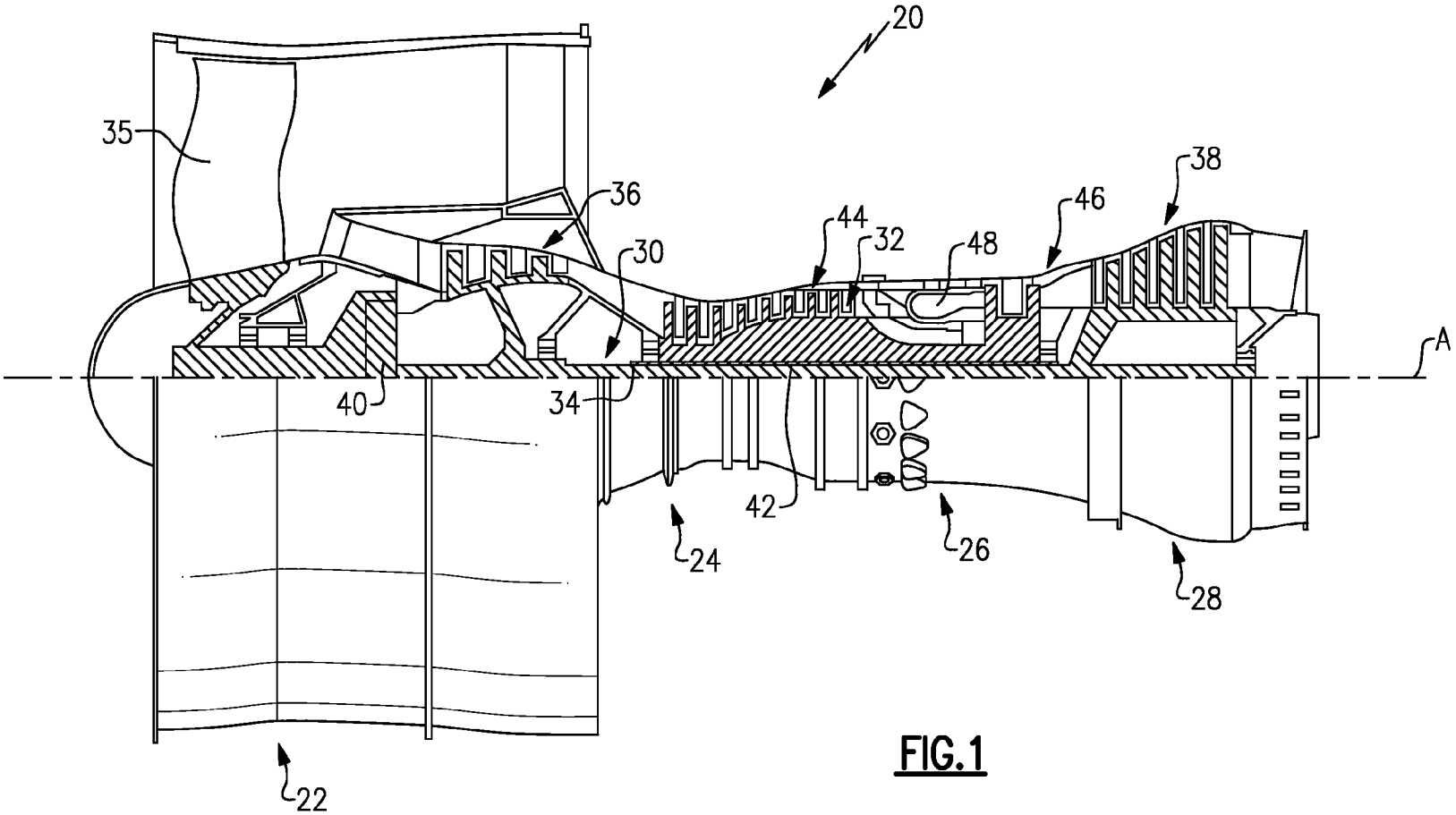
FIG. 1 is a schematic cross-section of a gas turbine engine.

FIG. 1 schematically illustrates a gas turbine engine 20. The gas turbine engine 20 is disclosed herein as two-spool turbofan that generally incorporates a fan section 22, a compressor section 24, a combustor section 26 and a turbine section 28 along an engine central longitudinal axis A. Alternative engines might include an augmentor section (not shown) among other systems or features. The fan section 22 drives air along a bypass flowpath while the compressor section 24 receives air from the fan section 22 along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines.

The engine 20 generally includes a low speed spool 30 and a high speed spool 32 mounted upon a multiple of bearing systems for rotation about the engine central longitudinal axis A relative to an engine stationary structure. The low speed spool 30 generally includes an inner shaft 34 that interconnects a fan 35, a low pressure compressor 36 and a low pressure turbine 38. The inner shaft 34 may drive the fan 35 either directly or through a geared architecture 40 to drive the fan 35 at a lower speed than the low speed spool 30. The high speed spool 32 includes an outer shaft 42 that interconnects a high pressure compressor 44 and high pressure turbine 46. A combustor 48 is arranged between the high pressure compressor 44 and the high pressure turbine 46.

Core airflow is compressed by the low pressure compressor 36 then the high pressure compressor 44, mixed with the fuel in the combustor 48 then expanded over the high pressure turbine 46 and low pressure turbine 38. The turbines 38, 46 rotationally drive the respective low speed spool 30 and high speed spool 32 in response to the expansion.

Figure 2:
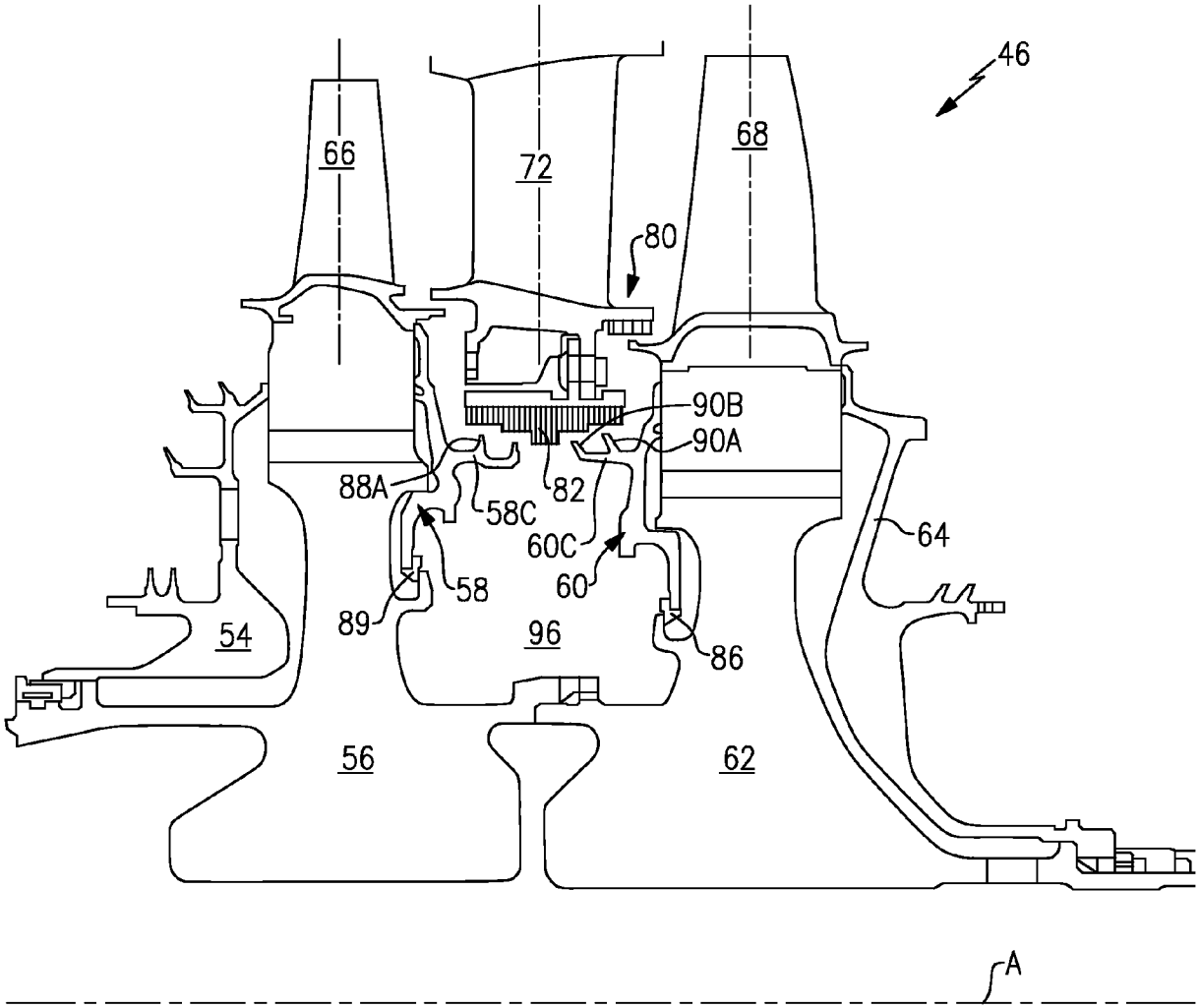
FIG. 2 is a sectional view of a high pressure turbine.

With reference to FIG. 2, the high speed turbine 46 generally includes a first turbine rotor disk 56, a first rear cover plate 58, a second front cover plate 60, and a second turbine rotor disk 62. Although two rotor disk assemblies are illustrated in the disclosed non-limiting embodiment, it should be understood that any number of rotor disk assemblies will benefit herefrom. A tie-shaft arrangement may, in one non-limiting embodiment, utilize the outer shaft 42 or a portion thereof as a center tension tie-shaft to axially preload and compress at least the first turbine rotor disk 56 and the second turbine rotor disk 62 therebetween in compression.

The components may be assembled to the outer shaft 42 from fore-to-aft (or aft-to-fore, depending upon configuration) and then compressed through installation of a locking element (not shown) to hold the stack in a longitudinal precompressed state to define the high speed spool 32. The longitudinal precompressed state maintains axial engagement between the components such that the axial preload maintains the high pressure turbine 46 as a single rotary unit. It should be understood that other configurations such as an array of circumferentially-spaced tie rods extending through web portions of the rotor disks, sleeve like spacers or other interference and/or keying arrangements may alternatively or additionally be utilized to provide the tie shaft arrangement.

Each of the rotor disks 56, 62 are defined about the axis of rotation A to support a respective plurality of turbine blades 66, 68 circumferentially disposed around a periphery thereof. The plurality of blades 66, 68 define a portion of a stage upstream and downstream respectively of a turbine vane structure 72 within the high pressure turbine 46. The cover plates 58, 60 operate as air seals for airflow into the respective rotor disks 56, 62. The cover plates 58, 60 also operate to segregate air in compartments through engagement with fixed structure such as the turbine vane structure 72.

An interstage seal assembly 80 is defined between the rotor disks 56, 62 through the interaction of the first rear cover plate 58 and the second front cover plate 60 with a seal assembly 82 of the turbine vane structure 72. The first rear cover plate 58 and the second front cover plate 60 reduces the overall rotating seal mass and potential for liberation of the interstage seal assembly 80. The first rear cover plate 58 and the second front cover plate 60 also divorce the disk rim to disk rim interaction which reduces the stress variation therebetween.

The first rear cover plate 58 is sealed to the first turbine rotor disk 56 through a first annular split ring 84 and the second front cover plate 60 is sealed to the second turbine rotor disk 62 through a second annular split ring 86. It should be understood that various attachment arrangements may alternatively or additionally be provided to attach the first rear cover plate 58 to the first rotor disk 56 and the second front cover plate 60 to the second rotor disk 62.

The first rear cover plate 58 includes a cylindrical extension 58C from which a first radially extending knife edge seal 88A and a second radially extending knife edge seal 88B extends. The first radially extending knife edge seal 88A is generally parallel to the second radially extending knife edge seal 88B. The first radially extending knife edge seal 88A extends radially outward a greater diameter than the second radially extending knife edge seal 88B.

The second front cover plate 60 also includes a respective cylindrical extension 60C which faces the cylindrical extension 58C. A first radially extending knife edge seal 90A and a second radially extending knife edge seal 90B extends from the cylindrical extension 60C. The first radially extending knife edge seal 90A is generally parallel to the second radially extending knife edge seal 90B but may be angled relative to the axis of rotation to control airflow. The first radially extending knife edge seal 90A extends radially outward a greater diameter than the second radially extending knife edge seal 90B.

Figure 3:
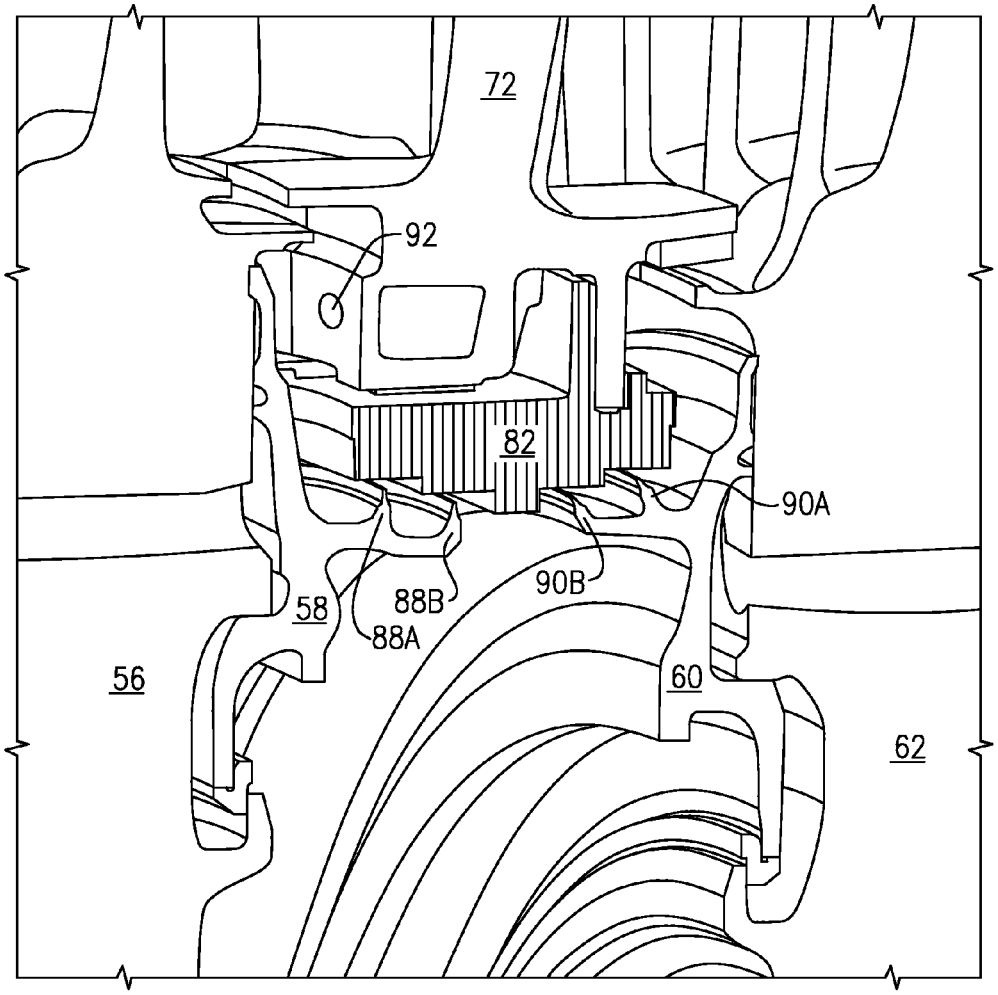
FIG. 3 is an enlarged perspective view of the high pressure turbine illustrating an interstage seal arrangement.

The radially extending knife edge seals 88A, 88B, 90A, 90B engage with the seal assembly 82 of the turbine vane structure 72 (also illustrated in FIG. 3). The seal assembly 82 in one non-limiting embodiment is an annular stepped honeycomb structure into which the radially extending knife edge seals 88A, 88B, 90A, 90B engage. The annular stepped honeycomb structure provides a circuitous air seal path as well as an abradable surface within which the radially extending knife edge seals 88A, 88B, 90A, 90B may interface.

Figure 4:
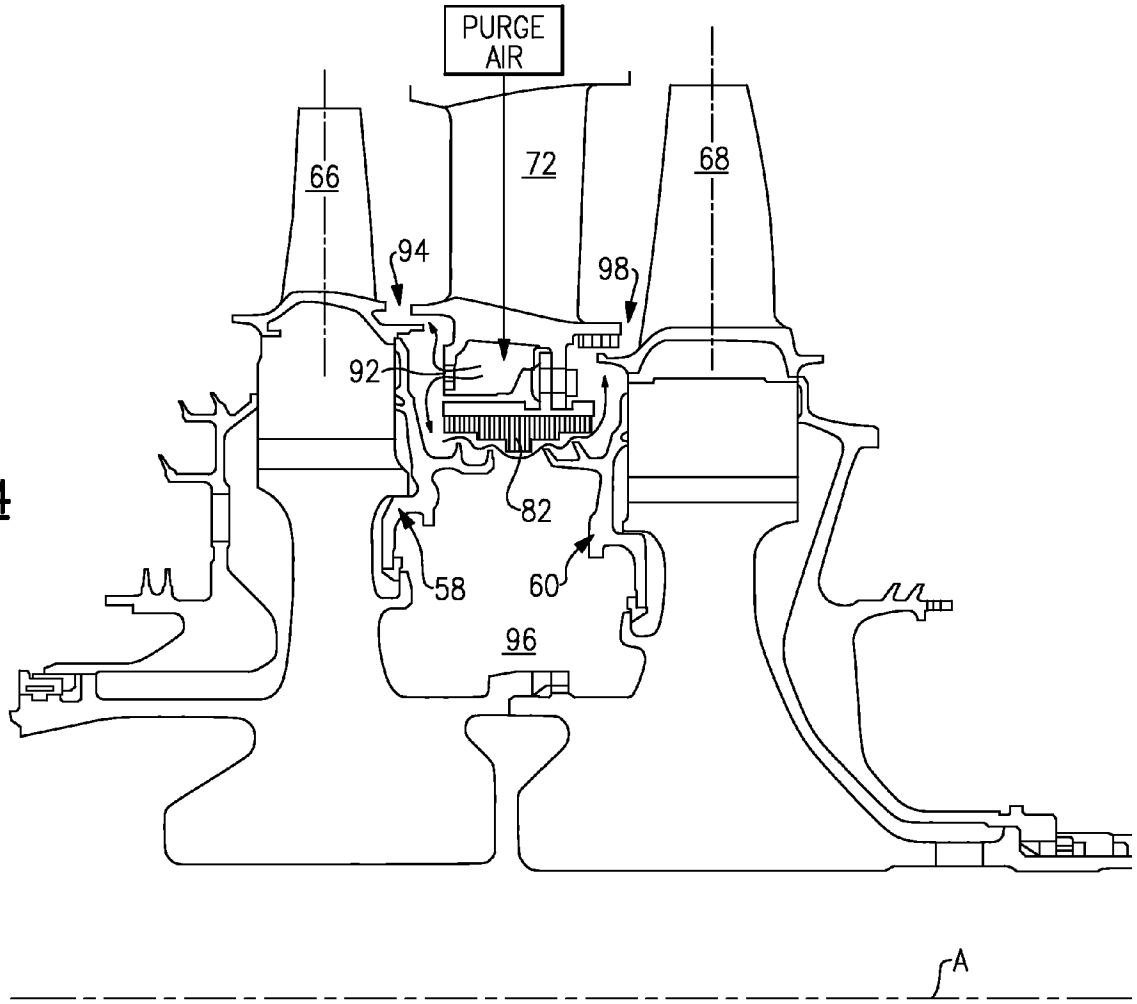
FIG. 4 is an enlarged sectional view of the high pressure turbine illustrating the interstage seal arrangement.

With reference to FIG. 4, purge air at a higher pressure than the highest upstream pressure adjacent to the an interstage seal assembly 80 from an upstream section of the engine 20, for example, the compressor section 24 is communicated into the turbine vane structure 72. The purge air exits apertures 92 in the turbine vane structure 72 into an upstream rim cavity 94 to preventingestion of hot gas core airflow and its contaminants into a rotating cavity 96 between the first and second stage disks. Some purge air communicates to a downstream rim cavity 98 past the radially extending knife edge seals 88A, 88B, 90A, 90B due to the lower pressure at the downstream rim cavity 98 relative to the upstream rim cavity 94. Nevertheless, the purge air and the interstage seal assembly 80 segregates the hot gas core airflow from the air within the rotating cavity 96. The interstage seal assembly 80 that extends between the first and second stage rotor disks 56, 62 thereby controls the amount of purge air that enters the downstream rim cavity 98.

Exemplary embodiments of the interstage seal assembly is described above in detail, however, the interstage seal assembly is not limited to the specific embodiments described herein, but rather, the interstage seal assembly can also be used in combination with other interstage seal assembly components and with other rotor assemblies.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present invention.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the invention may be practiced other than as specifically described. For that reason the appended claims should be studied to determine true scope and content.

What is claimed is:

1. An air seal assembly for a gas turbine engine comprising:

a first rotor disk defined about an axis of rotation;

a second rotor disk defined about said axis of rotation;

a vane structure axially between said first rotor disk and said second rotor disk;

a first cover plate including a first radially extending knife edge seal and a second radially extending knife edge seal defined about said axis of rotation, said first cover plate mountable to an aft surface of said first rotor disk for rotation therewith, said first radially extending knife edge seal and said second radially extending knife edge seal interfacing with said vane structure, and wherein said first radially extending knife edge seal defines a first diameter greater than a second diameter of said second radially extending knife edge seal; and a second cover plate with a radially extending knife edge seal defined about said axis of rotation, said second cover plate mountable to a forward surface of said second rotor disk for rotation therewith, said radially extending knife edge seal of the second cover plate interfacing with said vane structure.

2. The air seal assembly as recited in claim 1, wherein said first radially extending knife edge seal extends outward from a first cylindrical extension that extends from said first cover plate.

3. The air seal assembly as recited in claim 2, wherein said second radially extending knife edge seal extends outward from said first cylindrical extension.

4. The air seal assembly as recited in claim 3, wherein said second radially extending knife edge seal is generally parallel to said first radially extending knife edge seal.

5. The air seal assembly as recited in claim 4, wherein said second radially extending knife edge seal defines an axial end of said first cylindrical extension.

6. The air seal assembly as recited in claim 1, wherein said radially extending knife edge seal of the second cover plate extends outward from a second cylindrical extension that extends from said second cover plate.

7. The air seal assembly as recited in claim 1, wherein said first cover plate is mounted to an aft face of said first rotor disk.

8. The air seal assembly as recited in claim 7, wherein said second cover plate is mounted to a forward face of said second rotor disk.

9. The air seal assembly as recited in claim 1, wherein said first cover plate faces said second cover plate.

10. The air seal assembly as recited in claim 1, wherein said first rotor disk is attached to said second rotor disk.

11. The air seal assembly as recited in claim 1, wherein said vane structure is a turbine vane structure.

12. The air seal assembly as recited in claim 1, wherein said vane structure includes a honeycomb seal.

13. The air seal assembly as recited in claim 2, wherein said radially extending knife edge seal of said second cover plate extends outward from a second cylindrical extension that extends from said second cover plate.

14. The air seal assembly of claim 13 wherein said first cylindrical extension and said second cylindrical extension are substantially radially aligned.

15. The air seal assembly of claim 1 wherein said first radially extending knife edge seal and said second radially extending knife edge seal extend in a direction generally perpendicular to said axis of rotation.

16. A method to assemble an air seal assembly of a gas turbine engine comprising:

mounting a first cover plate with a first radially extending knife edge seal and a second radially extending knife edge seal defined about an axis of rotation to a first rotor disk for rotation therewith, the first radially extending knife edge seal and the second radially extending knife edge seal interfacing with a vane structure, wherein said first radially extending knife edge seal defines a first diameter greater than a second diameter of said second radially extending knife edge seal; and mounting a second cover plate with a radially extending knife edge seal defined about a axis of rotation to a second rotor disk for rotation therewith, the second radially extending knife edge seal interfacing with the vane structure.

17. The method as recited in claim 16, further comprising: mounting the first rotor disk to the second rotor disk.

18. The method as recited in claim 16, further comprising: axially spacing the first radially extending knife edge seal from the second radially extending knife edge seal.

19. The method of claim 16 wherein said first radially extending knife edge seal and said second radially extending knife edge seal extend in a direction generally perpendicular to said axis of rotation.

* * * * *